US006357628B1

(12) United States Patent
Long, Jr.

(10) Patent No.: US 6,357,628 B1
(45) Date of Patent: Mar. 19, 2002

(54) TAMPER EVIDENT PLASTIC CLOSURE

(75) Inventor: Charles J. Long, Jr., New Castle, PA (US)

(73) Assignee: International Plastics and Equipment Corporation, Pittsburgh, PA (US)

( * ) Notice: Subject to any disclaimer, the term of this patent is extended or adjusted under 35 U.S.C. 154(b) by 0 days.

(21) Appl. No.: 08/927,743

(22) Filed: Sep. 11, 1997

Related U.S. Application Data

(63) Continuation-in-part of application No. 08/838,133, filed on Apr. 15, 1997, which is a continuation-in-part of application No. 08/687,149, filed on Jul. 24, 1996, now Pat. No. 5,862,953, which is a continuation-in-part of application No. 08/633,225, filed on Apr. 16, 1996, now abandoned.

(51) Int. Cl.[7] ..... B65D 47/10
(52) U.S. Cl. ..... 222/153.06; 222/525; 222/541.06
(58) Field of Search ..... 222/153.05, 153.06, 222/522, 523, 525, 541.6

(56) References Cited

U.S. PATENT DOCUMENTS

| | | | | | |
|---|---|---|---|---|---|
| 2,998,902 | A | * | 9/1961 | Thomas et al. | 222/499 |
| 4,919,309 | A | * | 4/1990 | Arona-Delonghi | 222/153.06 |
| 5,104,008 | A | * | 4/1992 | Crisci | 222/525 |
| 5,328,063 | A | * | 7/1994 | Beck et al. | 222/525 |
| 5,456,374 | A | * | 10/1995 | Beck | 222/153.06 |
| 5,472,120 | A | * | 12/1995 | Stebick et al. | 222/153.06 |
| 5,588,562 | A | * | 12/1996 | Sander et al. | 222/153.06 |
| 5,655,685 | A | * | 8/1997 | Carr et al. | 222/525 |
| 5,657,906 | A | | 8/1997 | Rapchak et al. | 222/153.07 |
| 5,662,247 | A | | 9/1997 | Rapchak et al. | 222/153.07 |

* cited by examiner

*Primary Examiner*—Joseph A. Kaufman
(74) *Attorney, Agent, or Firm*—Cohen & Grigsby, P.C.

(57) ABSTRACT

The present invention generally provides a threaded tamper-evident closure having an annular hook-shaped flange extending radially inward from the inner surface of the tamper-evident band attached to the bottom edge of the closure body. The hook-shaped flange can be continuous or segmented and forms an upwardly angled surface for engaging the sealing flange on the bottle neck. A plurality of elevated areas extend upwardly from the tamper-evident band in spaced relation to the bottom edge of the closure body. The frangible elements connecting the tamper evident band to the lower edge of the closure depending annular flange may be configured to extend from these elevated areas as well as the non-elevated areas of the tamper-evident band. Pairs of cooperating ratchets may be used in lieu of or in combination with the elevated bridge areas to reduce the stress placed upon frangible elements and/or during cap application. A second preferred embodiment of the present invention provides a threaded tamper-evident plastic closure having a tamper-evident band containing the above-described features, for use with a tamper evident push-pull resealable pour spout which is substantially leak proof. The present invention also optionally provides a dust cover which encloses the push-pull pour spout closure when inserted on the container. The dust cover may be optionally provided with a tamper-evident sealing band which remains intact upon initial installation of the dust cover onto the container and which is broken when the dust cover is initially disturbed. When the dust cover is provided with a tamper-evident sealing band, the use of a band on the lower edge of the pour spout closure for providing tamper-evidency may be eliminated.

49 Claims, 13 Drawing Sheets

TAMPER EVIDENT PLASTIC CLOSURE

CROSS-REFERENCE

This application is a continuation-in-part of U.S. patent application Ser. No. 08/838,133 filed on Apr. 15, 1997, which is a continuation-in-part of U.S. patent application Ser. No. 08/687,149 filed on Jul. 24, 1996 now U.S. Pat. No. 5,862,953 which is a continuation-in-part of U.S. patent application Ser. No. 08/633,225 filed on Apr. 16, 1996 now abandoned.

FIELD OF THE INVENTION

This device generally relates to threaded tamper evident container closures, and to threaded tamper-evident closures having a push-pull resealable pour spout.

BACKGROUND OF THE INVENTION

Examples of threaded prior art tamper-evident closures are disclosed in U.S. patent application Ser. No. 08/332,589 filed Oct. 31, 1994 which is the priority document for International Patent Application No. PCT/IB95/01174 (published Jul. 11, 1996 under International Publication No. WO 96/20872), U.S. Pat. Nos. 4,664,278 and 4,971,212, and in U.K. Patent No. GB 2,177,384 and French Patent No. 2,682,357. Examples of threaded prior art tamper-evident closures having a push-pull resealable tamper-evident pour spout are disclosed, in U.S. patent application Ser. No. 08/332,140 filed Oct. 31, 1994 which is the priority document for International Patent Application No. PCT/IB95/01105 (published May 9, 1996 under International Publication No. WO 96/13442), and in U.S. Pat. No. 5,465,876.

The present invention provides an improved means of locking threaded tamper-evident closures to a bottle neck, by means of a uniquely shaped annular flange extending radially inward from the inner surface of the tamper-evident band attached to the bottom edge of the closure body. This flange, which can be continuous or segmented, can for example form an upwardly angled "hook" shaped surface for engaging the sealing flange on the bottle neck. The hook-like flange has a reverse basis that allows it to slide past the bottle neck sealing flange as the cap is snapped downward onto the container during installation. The hook-shaped flange then provides a positive grip on the bottle neck sealing flange to prevent removal of the closure while the tamper evident band remains intact. This hook-like sealing feature makes the closure of the present invention more difficult to detach from the container neck than existing prior art designs to minimize the risk of unintended removal while at the same time providing the same ease of installation as found in existing designs. The hook-shaped flange of the present invention can optionally be configured with a plurality of fins or gussets extending upwardly from and in a direction substantially perpendicular to the sealing surface of the flange. The purpose of the fins or gussets is to assist in breaking and dislodging the tamper-evident band from the remainder of the closure by engaging the exterior surface of the bottle neck as the tamper-evident seal is being broken.

Additionally, the present invention provides a novel configuration for protecting the integrity of frangible elements during installation of threaded tamper-evident closures. A plurality of elevated areas extend upwardly from the tamper-evident band in spaced relation to the bottom edge of the closure body. The purpose of these elevated areas is to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band. The purpose of attaching frangible elements to the elevated areas of the tamper-evident band is to assist in preventing axial misalignment of the tamper-evident band relative to the annular depending skirt portion of the closure upon subjecting the closure to torquing forces during assembly to the container neck. Additionally, at least one and preferably two pairs of cooperating ratchets may optionally be added to the tamper-evident band and depending skirt, respectively, in lieu of or in combination with the elevated bridge areas, to reduce the stress placed upon frangible elements and/or during cap application.

Prior art threaded push-pull pour spout closures providing tamper evidency and having tamper evident pour spouts have not always been leak proof at the spout closure interface. Generally, prior art push-pull pour spout closures that are reusable do not provide effective sealing at the juncture between the spout opening and the plug positioned in the opening when the spout is closed. Because of the very small diameter of the opening and the concern for safety, it is not possible to add non-integrated sealing means. The present invention solves this problem by utilizing a closure plug which combines a circular closure disk with an integral annular skirt depending from the periphery of the disk thereby defining a hollow cavity for the plug interior and increasing the structural flexibility of the plug. The increased structural flexibility provided by the hollow cavity causes inward deformation of the plug skirt upon engagement with annular flanges integrated into the periphery of the spout closure central opening to create a form-fitting leak tight seal. A plurality of circumferentially spaced dimples optionally extend from the exterior wall of the pour spout. These dimples facilitate breaking the frangible elements connecting the tamper evident band to the push-pull pour spout closure. Optionally, one or more continuous or discontinuous locking beads on the pour spout can be configured to engage one or more continuous or discontinuous locking beads on the pour spout closure to provide a structure for securing the pour spout closure to the pour spout the closed position and/or to prevent removal of the pour spout closure from the pour spout in the open position.

The present invention also optionally provides a dust cover which encloses the push-pull pour spout closure when inserted on the container. One example of the use of dust covers as a means for sealing containers is shown in U.S. Pat. No. 5,456,374. The dust cover of the present invention is optionally provided with a tamper-evident sealing band which remains intact upon initial installation of the dust cover onto the container and which is broken when the dust cover is initially disturbed. The purpose of the dust cover is to provide an indication of whether the push-pull pour spout closure has been exposed subsequent to the sealing of the container. When the dust cover is provided with a tamper-evident sealing band, the use of a band on the lower edge of the pour spout closure for providing tamper-evidency may be eliminated.

Accordingly, it is an object of the present invention to provide a threaded tamper-evident closure having an annular hook-shaped flange extending radially inward from the inner surface of the tamper-evident band attached to the bottom edge of the closure body, for locking the closure to a bottle neck while the tamper evident band is intact.

It is a further object of the present invention to provide a threaded tamper-evident closure having an annular hook-shaped flange with a plurality of fins or gussets extending upwardly from and in a direction substantially perpendicular to the sealing surface of the flange, to assist in breaking and dislodging the tamper-evident band from the remainder of the closure.

It is a further object of the present invention to provide a threaded tamper-evident closure having frangible elements attached from and between a plurality of elevated areas extending upwardly from the tamper-evident band, for protecting the integrity of frangible elements during installation of the closure on a bottle neck.

It is a further object of the present invention to provide pairs of cooperating ratchets in lieu of or in combination with the elevated bridge areas to reduce the stress placed upon frangible elements and/or during cap application.

It is a further object of the present invention to provide a threaded tamper-evident closure with a reusable push-pull pour spout having a closure plug of increased structural flexibility to provide a more effective leak tight seal.

It is a further object of the present invention to provide a dimple means for facilitating the breakage of frangible elements on the tamper evident band of the push-pull pour spout closure.

It is a further object of the present invention to provide a threaded tamper-evident closure with a reusable push-pull pour spout that utilizes an upwardly angled hook-shaped annular flange to prevent removal of the closure body from a bottle neck while the tamper evident band remains intact.

It is a further object of the present invention to provide a threaded tamper-evident closure with a reusable push-pull pour spout having a plurality of fins or gussets extending upwardly from and in a direction substantially perpendicular to the sealing surface of an annular hook-shaped flange, to assist in breaking and dislodging the tamper-evident band from the remainder of the closure body.

It is a further object of the present invention to provide frangible elements attached from and between a plurality of elevated areas extending upwardly from the tamper-evident band, for protecting the integrity of frangible elements during installation of the closure on a bottle neck.

It is a further object of the present invention to provide one or more continuous or discontinuous locking beads on the pour spout configured to engage one or more continuous or discontinuous locking beads on the pour spout closure to provide a structure for securing the pour spout closure to the pour spout the closed position and/or to prevent removal of the pour spout closure from the pour spout in the open position.

It is a further object of the present invention to provide a dust cover which encloses the push-pull pour spout closure when inserted on the container.

It is a further object of the present invention to provide a dust cover with a tamper-evident sealing band which encloses the push-pull pour spout closure when inserted on the container.

It is a further object of the present invention to eliminate the need for a band on the lower edge of the pour spout closure to provide tamper-evidency for the pour spout by providing a dust cover with a tamper-evident sealing band which encloses the push-pull pour spout closure when inserted on the container.

SUMMARY OF THE INVENTION

A first preferred embodiment of the present invention generally provides a threaded tamper-evident closure having an annular hook-shaped flange extending radially inward from the inner surface of the tamper-evident band attached to the bottom edge of the closure body. The hook-shaped flange can be continuous or segmented and can for example form an upwardly angled surface for engaging the sealing flange on the bottle neck. The edge of the flange preferably lies at an angle with a plane normal to the inner surface of the tamper-evident band, thereby defining a grooved "hook" which slides over the locking flange on the bottle neck when the closure is placed on the container but which engages and locks the closure to the container neck when removal of the closure is attempted with the tamper-evident band intact. The hook-shaped flange can optionally be configured with a plurality of fins or gussets extending upwardly from and in a direction substantially perpendicular to the sealing surface of the flange. A plurality of elevated areas extend upwardly from the tamper-evident band in spaced relation to the bottom edge of the closure body. The frangible elements connecting the tamper evident band to the lower edge of the closure depending annular flange may be configured to extend from these elevated areas as well as the non-elevated areas of the tamper-evident band. Additionally, at least one and preferably two pairs of cooperating ratchets may optionally be added to the tamper-evident band and depending skirt, respectively, in lieu of or in combination with the elevated bridge areas, to reduce the stress placed upon frangible elements and/or during cap application.

A second preferred embodiment of the present invention provides a threaded tamper-evident plastic closure having a tamper-evident band containing the above-described features, for use with a tamper evident push-pull resealable pour spout which is substantially leak proof. The push-pull pour spout has an opening which is partially closed by a second top having a secondary opening therein and a plug spaced thereabove with upwardly angled legs formed integrally with the closure. The plug takes the form of a circular closure disk having an integral annular skirt depending from the periphery of the disk that attaches the plug to the angular legs thereby defining a hollow cavity for the plug interior and increasing the structural flexibility of the plug. Integrated into the periphery of the secondary opening is at least one and preferably two annular flanges which engage the plug skirt when the secondary opening is closed to seal the spout. The annular flanges cause inward deformation of the plug skirt upon engagement to create a form-fitting leak proof seal. A plurality of circumferentially spaced dimples optionally extend from the exterior wall of the pour spout. These dimples facilitate breaking the frangible elements connecting the tamper evident band to the spout closure. Optionally, one or more continuous or discontinuous locking beads on the pour spout can be configured to engage one or more continuous or discontinuous locking beads on the pour spout closure to provide a structure for securing the pour spout closure to the pour spout the closed position and/or to prevent removal of the pour spout closure from the pour spout in the open position.

The present invention also optionally provides a dust cover which encloses the push-pull pour spout closure when inserted on the container. The dust cover may optionally be provided with a tamper-evident sealing band which remains intact upon initial installation of the dust cover onto the container and which is broken when the dust cover is initially disturbed. When the dust cover is provided with a tamper-evident sealing band, the use of a band on the lower edge of the pour spout closure for providing tamper-evidency may be eliminated.

Other advantages of the present invention will become apparent from a perusal of the following detailed description of a presently preferred embodiment taken in connection with the accompanying drawings.

DETAILED DESCRIPTION OF THE PRESENTLY PREFERRED EMBODIMENTS

Figure 1:
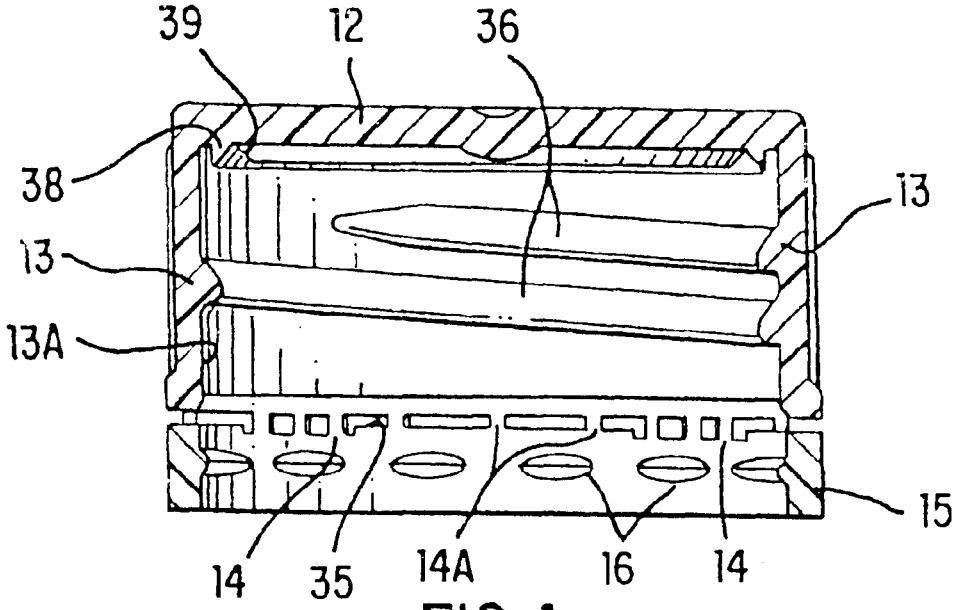
FIGS. 1, 1A and 1B are sectional views of a threaded tamper-evident closure of the present invention.
Figure 1A:
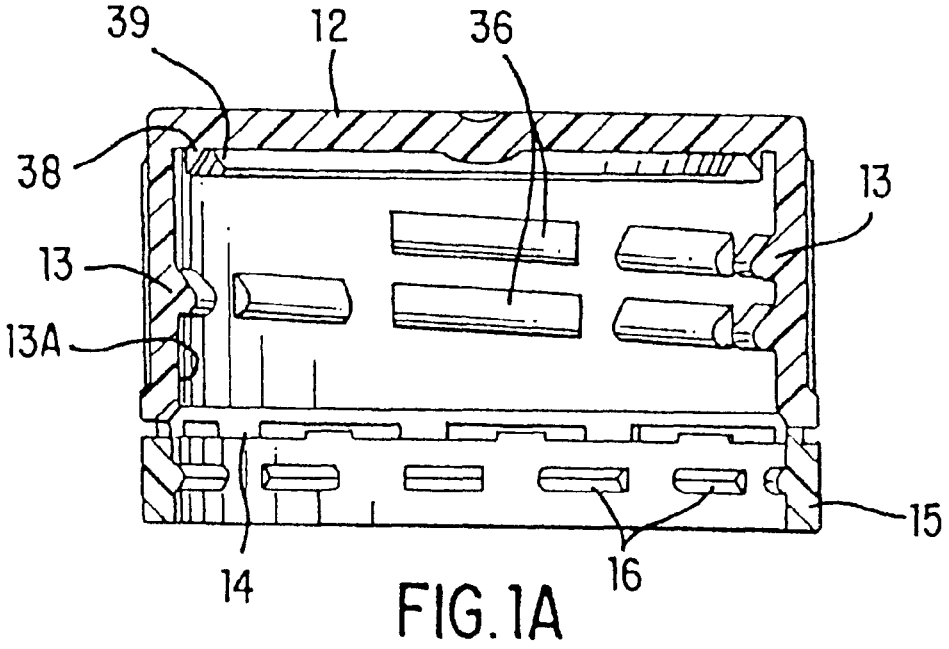

Referring to FIGS. 1–6 and 1A–6A of the drawings, a first preferred embodiment of a plastic threaded tamper-evident closure is shown having a seal disc 12 and a depending annular skirt 13 extending therefrom. The depending annular skirt 13 has inwardly extending spiral threads 36 formed on its interior annular surface 13*a* which can be either continuous as shown in FIG. 1 or segmented as shown in FIG. 1A. If segmented, threads 36 segments may be offset or aligned in spaced vertical relation to one another defining spaced parallel threaded segment pairs as shown in FIG. 1A. A frangible annular tamper-evident band 15 is integrally molded to annular skirt 13 by interconnecting frangible elements 14 and 14*a*. The tamper-evident band 15 is flexible for initial insertion of the closure on the neck portion 18 of the container as will be understood by those skilled in the art.

Figure 5:
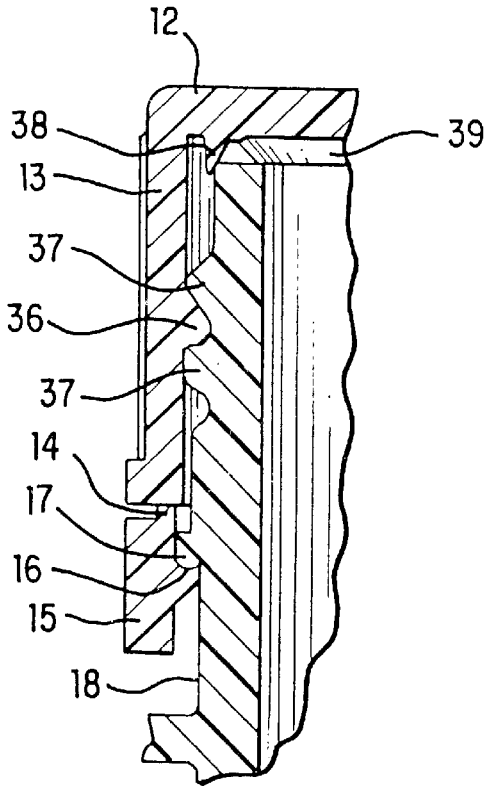
FIG. 5 is an enlarged partial cross-sectional view of the closure of the present invention as installed on a container neck.
Figure 6:
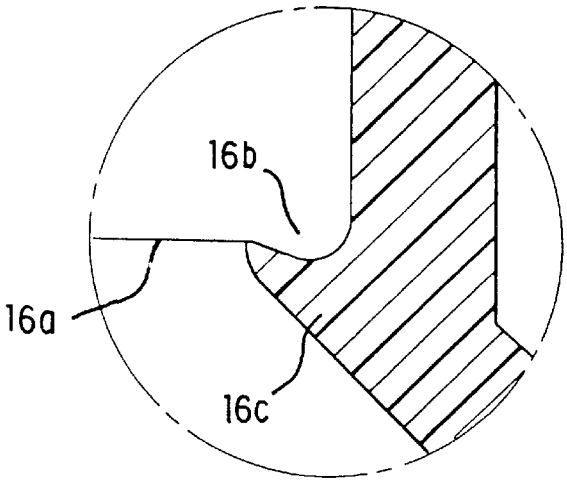
FIG. 6 is an exploded view of the hook-shaped locking flange of the present invention.
Figure 6A:
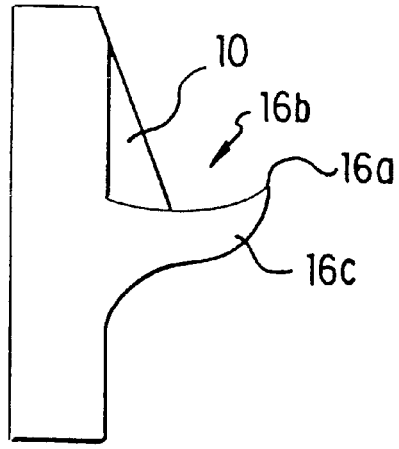
FIG. 6A is an exploded view of the hook-shaped locking flange of the present invention displaying a plurality of fins or gussets.
Figure 6B:
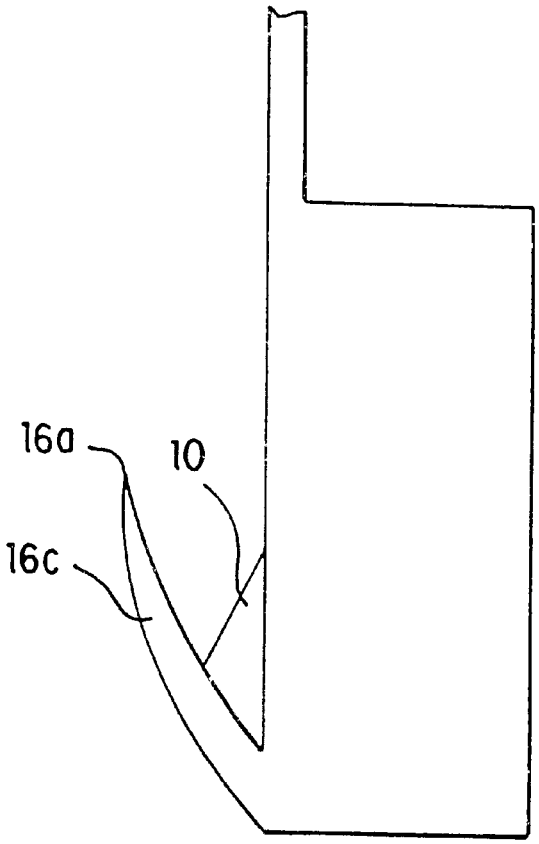
FIG. 6B is an exploded view of the hook-shaped locking flange of the present invention positioned adjacent to the bottom edge of the closure tamper-evident band and having and having a surface substantially parallel to the interior surface of the closure tamper-evident band.

Referring to FIGS. 1, 1A, 4 and 4A of the drawings, arcuate hook-like flanged locking projections 16 are circumferentially spaced about the inner surface of said tamper evident ring 15 and are positioned so that they are engageable under an annular locking flange 17 to lock the closure on a bottle neck 18 as seen in FIG. 5 of the drawings. As can be seen in FIG. 6, projections 16 can for example comprise edges 16*a* defining grooves 16*b* formed on radially upwardly extending annular flanges 16*c*. Flanges 16*c* are preferably discontinuous but can be continuous. Edge 16*a* and groove 16*b* provide a "hook" shape for engaging the annular locking flange 17 which has a radius substantially the same as groove 16*b*. The surface of flange 16*c* lies at an angle with a plane normal to the inner surface of the tamper-evident band 15, thereby defining a grooved "hook" with a reverse basis allowing flange 16*c* to slide over the locking flange 17 on the bottle neck 18 when the closure is placed on the container but which engages and locks the closure to the container when removal of the closure is attempted with the tamper-evident band 15 intact. As shown in FIG. 6B, the aforementioned angle may vary over the surface of flange 16*c* such that at least a portion of the flange surface lies substantially parallel to the interior surface of the tamper indicating band 15. This flanged edge and groove configuration 16*a*–16*c* may be positioned at any elevation the surface of tamper-evident band 15, including a position adjacent to the bottom edge of tamper-evident band 15 as shown in FIG. 6B. Because groove 16*b* is undercut, a mold core must be used that frees or permits removal of undercut prior to stripping the closures from the mold. Various techniques are known to those skilled in the art including the use of movable core sleeves which free the undercut section of the mold. As shown in FIGS. 6A and 6B, the hook-shaped flange 16*c* of the present invention can optionally be configured with a plurality of fins or gussets 10 extending upwardly from and in a direction substantially perpendicular to the sealing surface of the flange. The purpose of the fins or gussets 10 is to assist in breaking and dislodging the tamper-evident band from the remainder of the closure by engaging the exterior surface of the bottle neck as the tamper-evident seal is being broken.

Figure 1B:
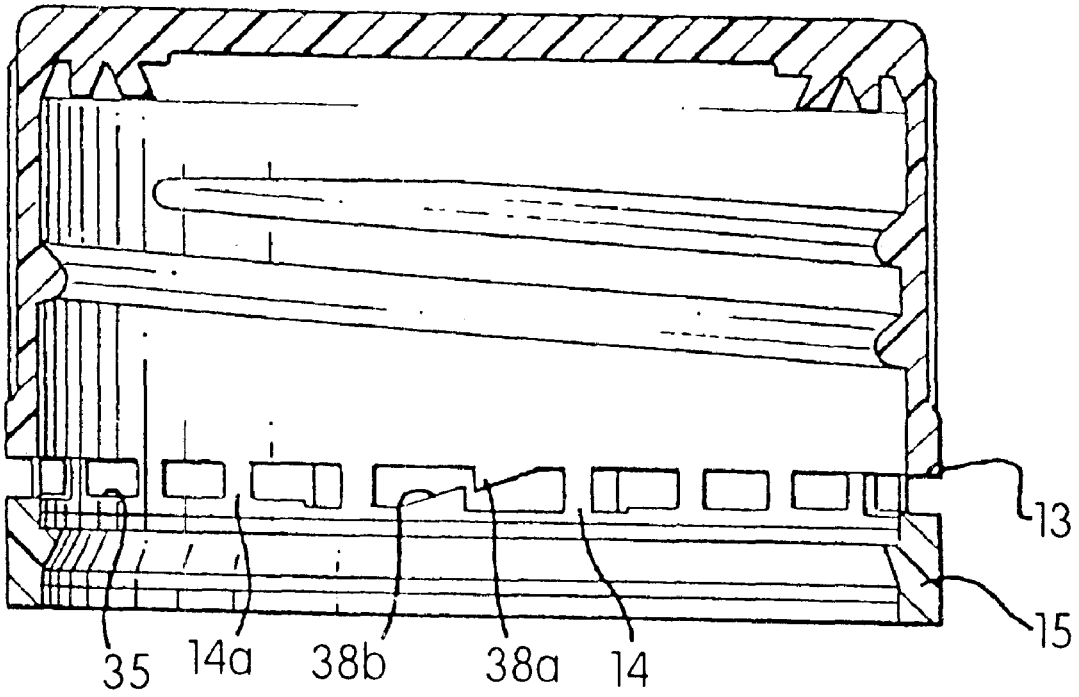
Figure 2A:
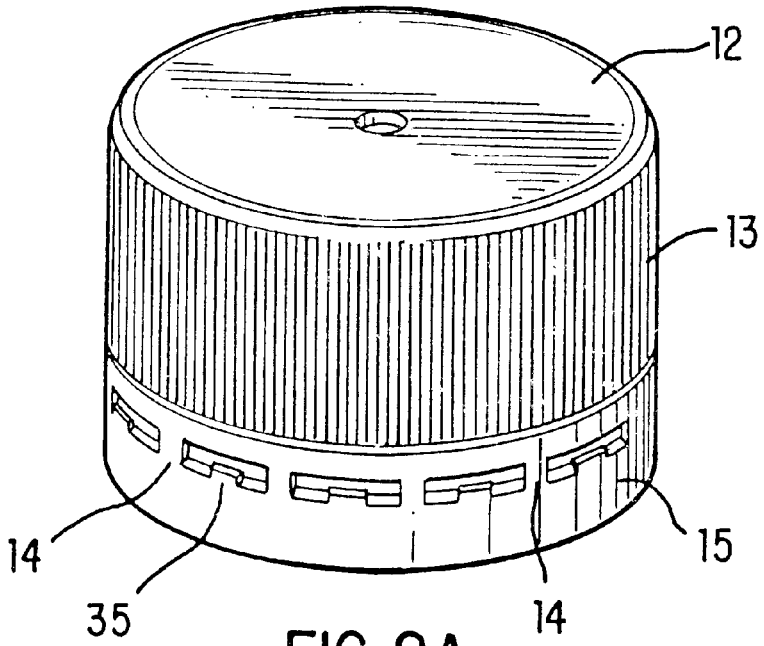
FIGS. 2 and 2A are perspective views of a threaded tamper-evident closure of the present invention.
Figure 2:
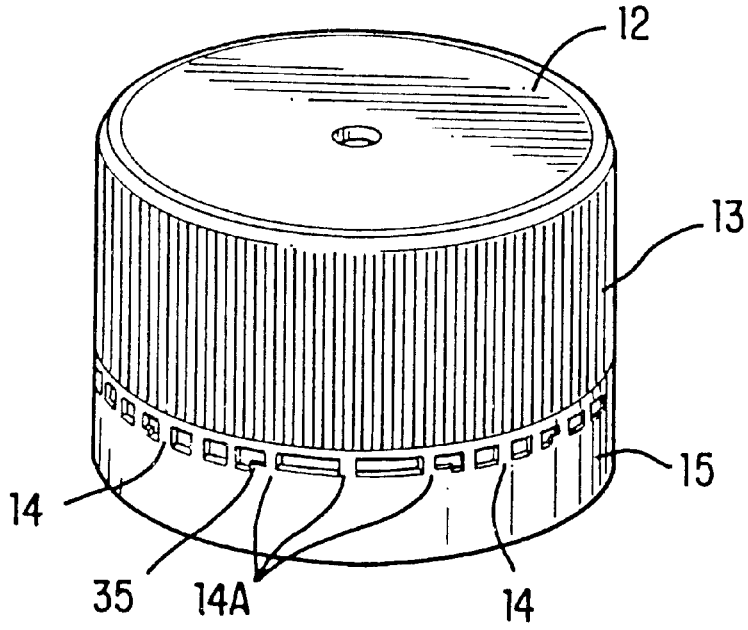
Figure 3:
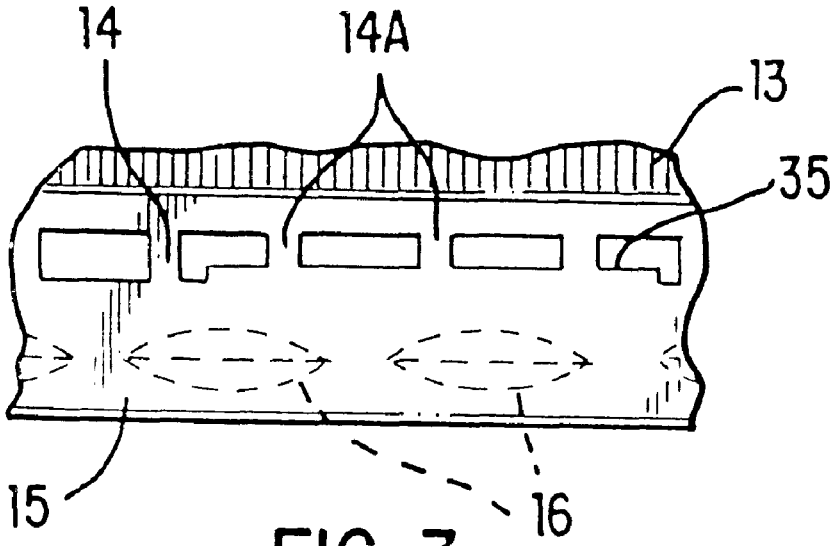
FIGS. 3 and 3A are enlarged sectional views of the tamper-evident band of the closure of the present invention.
Figure 3A:
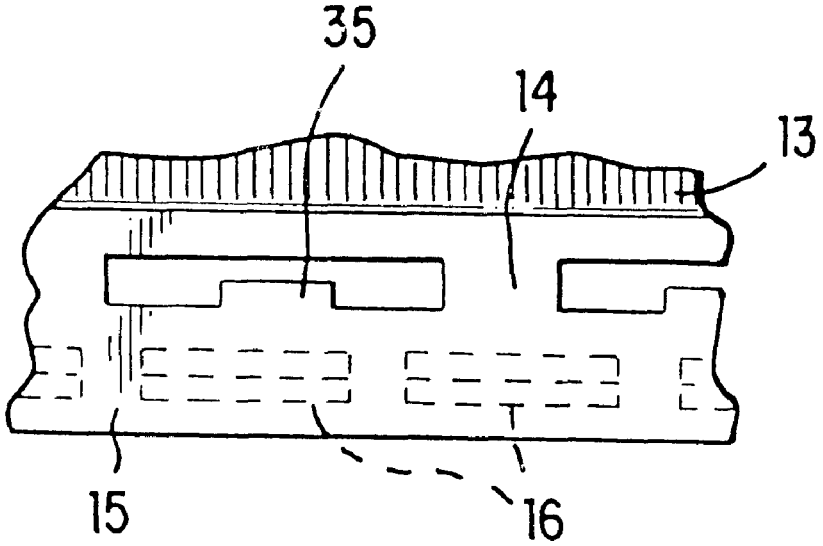
Figure 4:
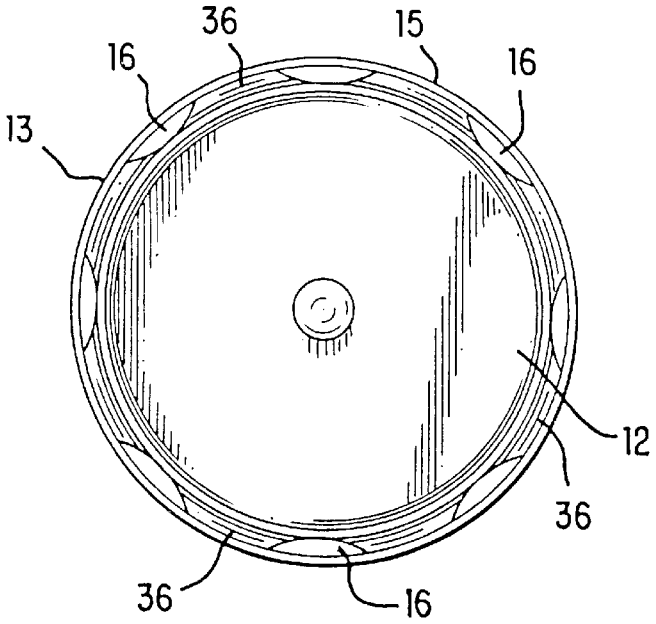
FIGS. 4 and 4A are bottom plan views of the closure of the present invention.
Figure 4A:
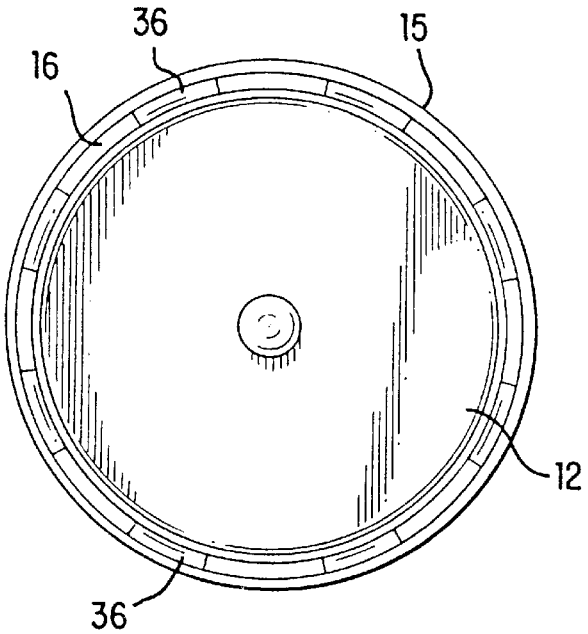

Referring to FIGS. 1, 1A and 1B, 2–2A and 3–3A, it will be seen that the tamper-evident band 15 has a series of circumferentially spaced elevated bridge areas 35 extending towards the closure depending annular skirt 13. Each of the elevated bridge areas 35 defines a reinforcing support for the tamper-evident band 15 during molding and insertion of the closure on the bottle neck. As shown in FIGS. 1A, 2A and 3A, frangible elements 14 can be configured to extend from the tamper evident band 15 between the elevated bridge areas 35. Alternately, as shown in FIGS. 1–1B, 2 and 3, frangible elements 14*a* can be configured to extend from the tops of the elevated bridge areas 35 to the tamper evident band 15 in addition to the frangible elements 14 which are located between the elevated bridge areas 35. Arcuate projections 16 are shown in FIGS. 1A–4A in a vertically aligned relation with the respective elevated bridge areas 35 with frangible elements 14 therebetween, but projections 16 can be offset with respect to both the elevated bridge areas 35 and the frangible elements 14 or 14*a*, as shown in FIGS. 1–4.

Each of the bridge areas 35 provides support for the tamper-evident band 15 during the closure capping process on the bottle neck portion by preventing excessive vertical deformation and movement of the ring against the depending skirt 13 which would otherwise break the frangible elements 14 prematurely, since the elevated bridges 35 act as stops against the depending closure skirt 13. The same protection of the tamper-evident band 15 is apparent during molding of the closure at a time when the frangible elements 14 can be readily damaged when stripped from the mold. The purpose of attaching frangible elements 14*a* to the elevated bridge areas 35 of the tamper-evident band 15 is to assist in preventing axial misalignment of the tamper-evident band 15 relative to the closure annular depending skirt 13 upon subjecting the closure to torquing forces during assembly to the container neck 18. Finally as shown in FIG. 1B, at least one and preferably two pairs of cooperating ratchets 38*a* and 38*b* may optionally be added to the tamper-evident band 15 and depending skirt 13, respectively, in lieu of or in combination with the elevated bridge areas 35, to reduce the stress placed upon frangible elements 14 and/or 14*a* during cap application.

As can be seen in FIG. 5, the closure spiral thread 36 engages a registering-spiral thread 37 extending outwardly from the container neck portion 18 a known distance. The resulting action of the closure rotation for removal twists and elevates the closure on the neck portion deforming and breaking the respective frangible elements 14 and 14*a* separating the tamper-evident band 15 from the depending annular skirt 13. By referring to FIG. 4A, the closure can be seen wherein the relative positioning of the segmented spiral thread 36 and the arcuate projections 16 on the tamper-evident band 15 can be seen in a circumferentially spaced overlapping relationship providing for offsetting points of engagement with respect to registering locking annular flange 17 and spiral thread 37 on the container neck 18, respectively.

Figure 7:
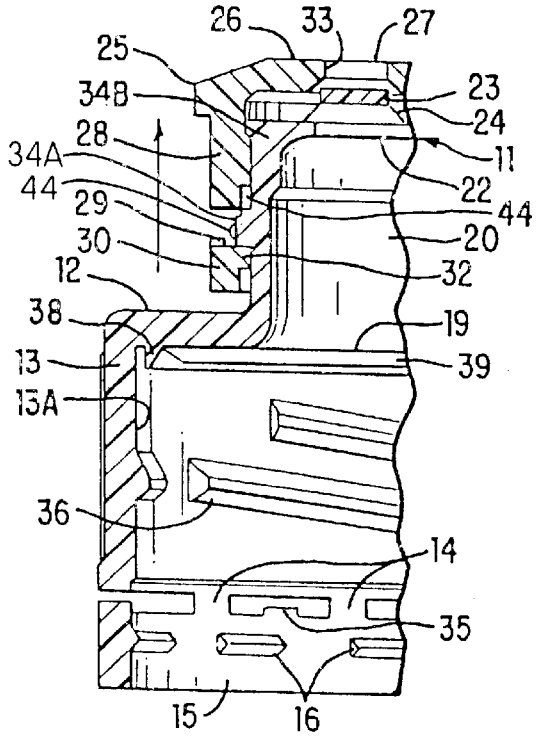
FIG. 7 is a vertical cross-section through a portion of a resealable push-pull pour spout closure with the push-pull cap in an open position.
Figure 7A:
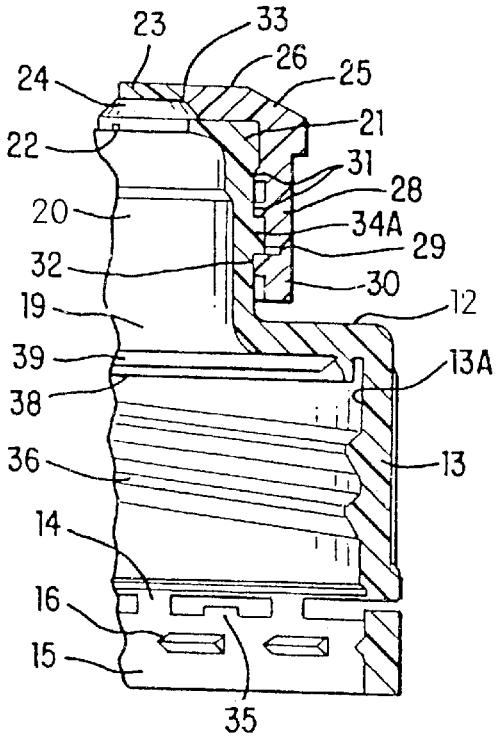
FIG. 7A is a vertical cross-section through a portion of the resealable push-pull pour spout closure with the push-pull cap in a closed position.

FIGS. 7 and 7A provide the second preferred embodiment of the invention showing a resealable push-pull pour spout closure. The closure is preferably made of high density polyethylene which also is made of high density polyethylene, except for pour spout 20 which is preferably low density polypropylene. As shown in FIGS. 7–7A and 8–8A the portion of the closure extending below seal disc 12 can be configured in accordance with any of the embodiments shown and described above.

Referring to FIGS. 7 and 7A, an opening 19 is preferably formed in the center of seal disc 12 with an upstanding cylindrical pour spout 20 positioned in registry with opening 19. The upper end of the pour spout 20 includes a secondary top portion 21 which is apertured at 22. A closure plug 23 is positioned on the secondary top portion 21 in spaced relation to aperture 22 by a plurality of circumferentially spaced angularly arranged upwardly extending supports 24. A push-pull cap 25 is positioned on the upstanding cylindrical pour spout 20 and has a top surface 26 with a central opening 27 which is designed to register with the plug 23 to form a secondary closure when the push-pull cap 25 is in a closed position resting on the secondary top portion 21 of the upstanding cylindrical pour spout 20, as illustrated in FIG. 7A.

Figure 10:
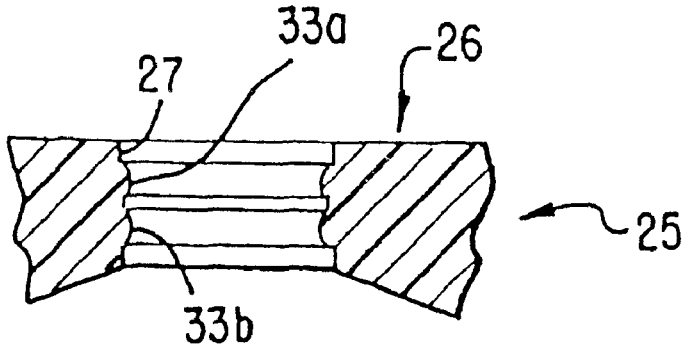
FIG. 10 is an enlarged partial section view of the secondary opening of the push-pull cap.
Figure 10A:
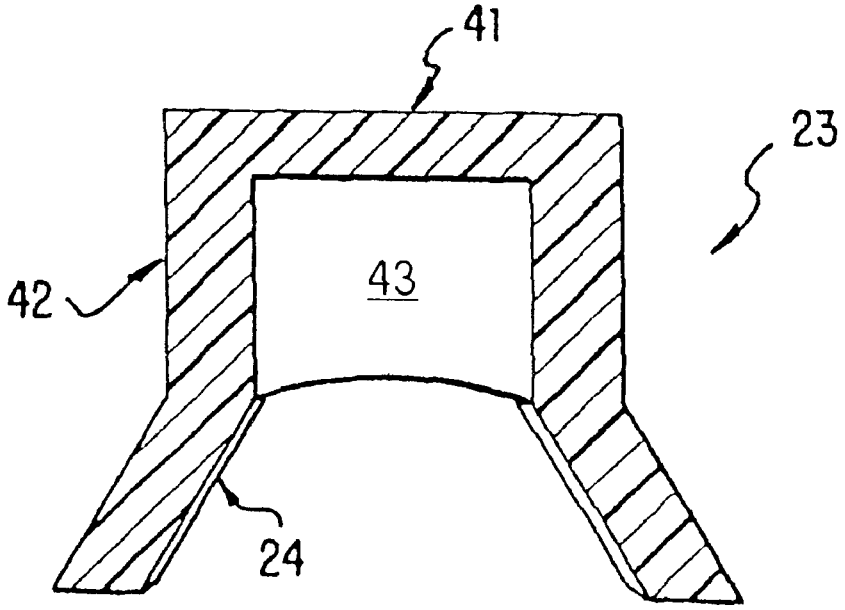
FIG. 10A is an exploded view of the secondary closure plug of the present invention.

Referring to FIG. 10A, the plug 23 is formed by a circular closure disk 41 having an integrally molded annular skirt 42 depending from the periphery of the disk 41. The sidewall of skirt 42 is dimensioned to be thin enough to allow inward deformation of the sidewall upon contact with the central opening surface 27 of spout cap 25 while at the same time being thick enough to ensure that the plug 23 will not break off with repeated use. Skirt 42 attaches plug 23 to the angular supports 24 thereby defining a hollow cavity 43 for the plug interior.

Located on the inner surface of central opening 27 is at least one, but preferably a pair of annular, preferably arcuate, flanges 33 which radially project into opening 27. As shown in FIG. 10, a pair of annular flanges 33*a* and 33*b* are integrally molded with the inner surface of central opening 27. A pair of flanges 33*a* and 33*b* are especially preferable for sealing fluids such as water. However, a single flange is sufficient for containers used for fluids having a higher viscosity such as fruit juice. The radially projecting flanges 33 engage depending plug skirt 42 to form a leak tight seal for the spout 20. The attachment of skirt 42 to the periphery of disk 41 increases the structural flexibility of the plug 23 thereby forcing the plug skirt 42 to flex and inwardly deform upon engagement with radially projecting flanges 33. This deformation causes a form fit which increases the tightness of the secondary closure seal thereby resulting in a superior leak-tight arrangement when compared to other designs currently in the state of the art.

Figure 8:
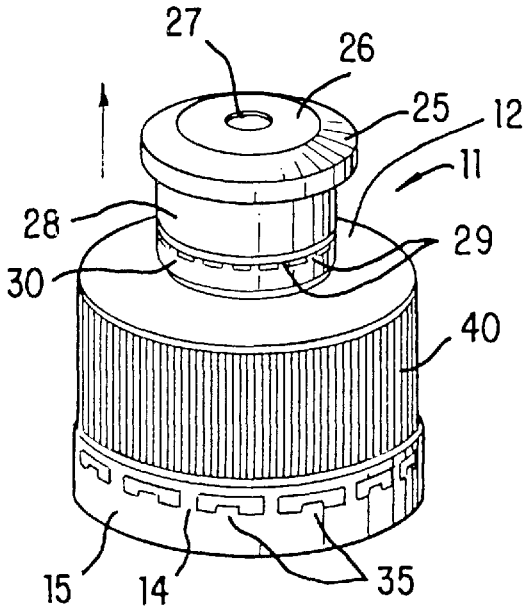
FIG. 8 is a perspective view of the resealable push-pull pour spout closure.
Figure 8A:
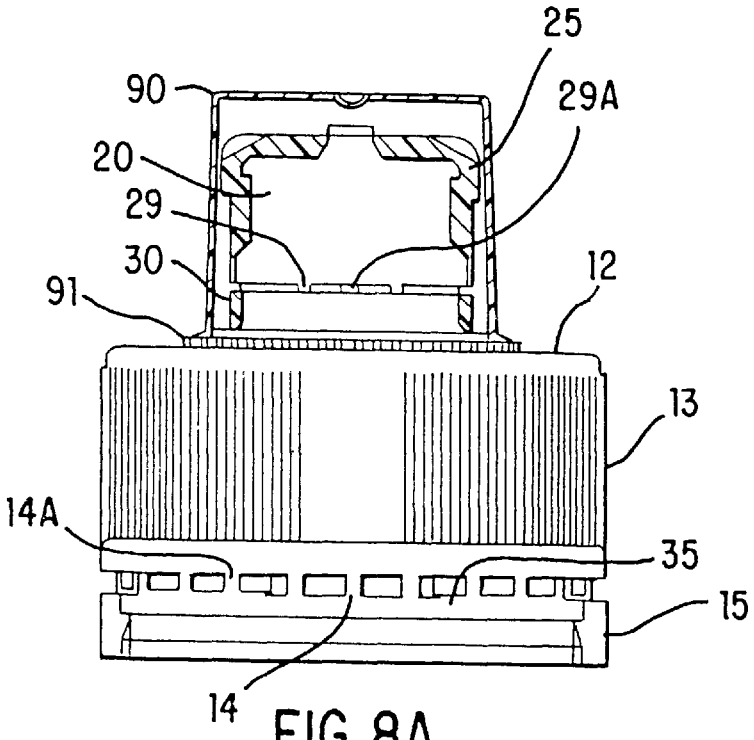
FIG. 8A is a sectional view of the resealable push-pull pour spout closure with tamper evident dust cover installed.
Figure 9:
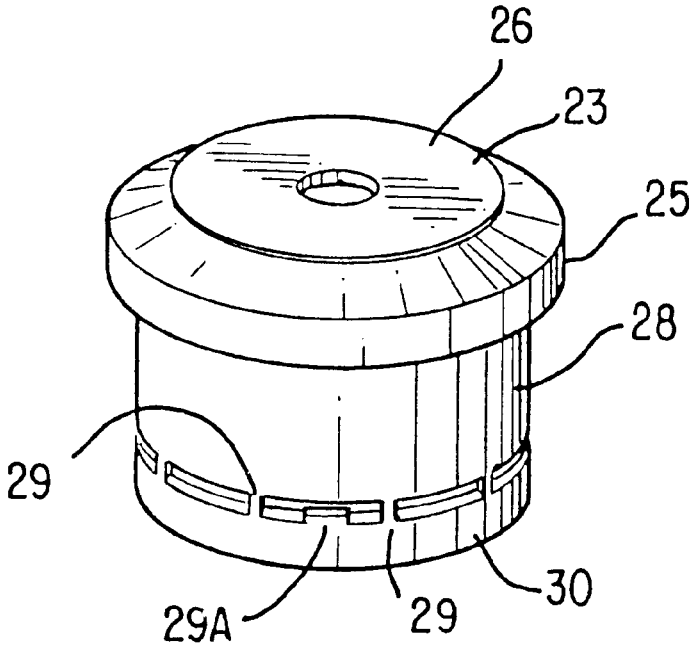
FIG. 9 is a perspective view of a portion of the push-pull cap.

Preferably, push-pull cap 25 has a depending cylindrical body member 28 with a plurality of annularly spaced frangible elements 29 connected on its lower perimeter edge to a secondary tamper indicating band 30. The cylindrical body member 28 has a pair of vertically spaced internal annular flanges 31 which slidably engage the outer surface of the upstanding cylindrical pour spout 20. The secondary tamper-evident band 30 also has an internal annular flange 32 which is slidably engaged at the exterior of the upstanding cylindrical pour spout 20. The upstanding cylindrical pour spout 20 has two outwardly extending annular flanges 34*a* and 34*b*, respectively on the exterior thereof. The internal annular flange 32 is oppositely disposed with respect to the secondary top portion 21 and outwardly extending flange 34*a*. The outwardly extending flange 34*a* is positioned above the seal disc 12 and is oppositely disposed to and between the annular flanges 31 and 32 on the cylindrical body member 28 and the secondary tamper evident band 30, respectively. As shown in FIGS. 8A and 9, the secondary-tamper evident band 30 may contain elevated bridge portions 29*a* extending from and/or between frangible elements 29, similar to and for the same purpose as the configuration shown on the bottom tamper-evident band 15 shown in FIGS. 2, 2A, 3 and 3A.

Figure 12:
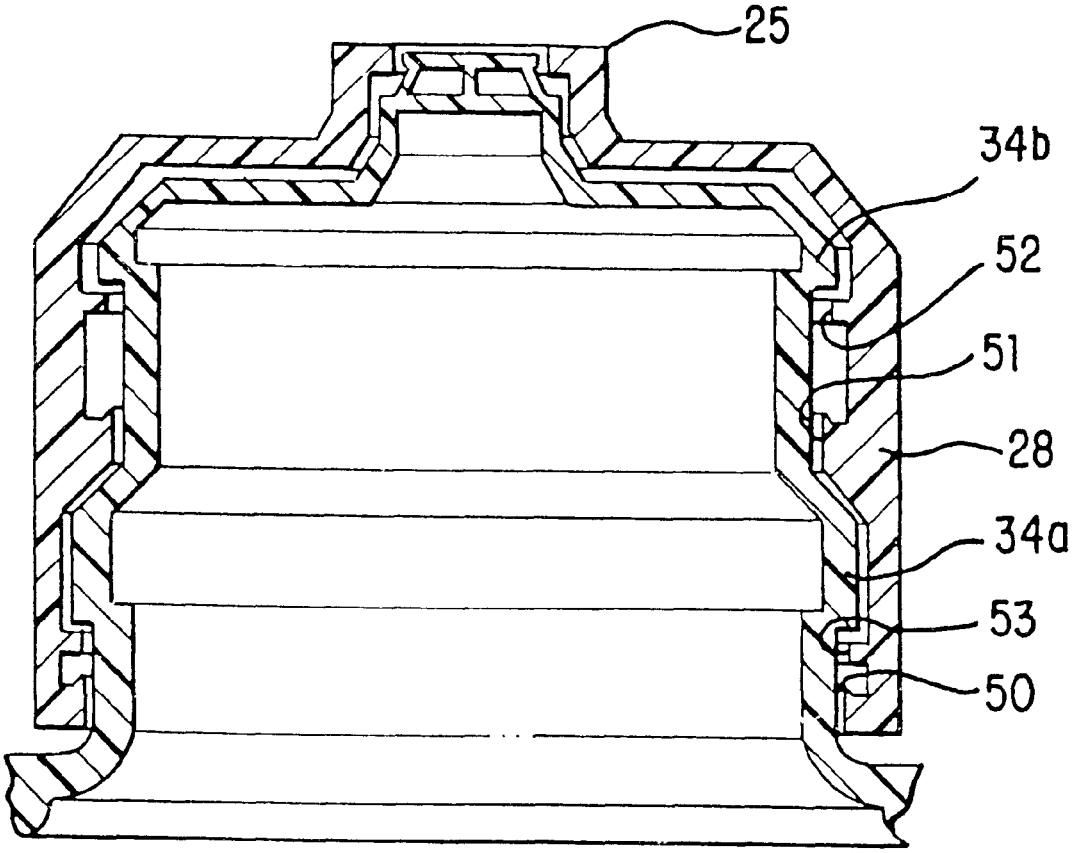
FIG. 12 is a vertical cross-section through a portion of a resealable push-pull pour spout and closure showing locking beads on the pour spout configured to engage locking beads on the pour spout closure.

In assembled form as illustrated in FIGS. 7–7A and 8–8A, the secondary tamper evident band 30 is joined by the frangible elements 29 to the cylindrical body member 28. The push-pull cap 25 is incapable of moving upwardly due to the interengagement of the internal annular flange 32 with the outwardly extending flange 34*a* on the cylindrical pour spout 20. Thus the cylindrical body member 28 of the push-pull cap 25 is incapable of vertical movement such as required to move the apertured top surface 26 above the plug 23 until sufficient force is applied to the push-pull cap 25 to break away the frangible elements 29 whereby the push-pull cap 25 can move to the position illustrated in FIG. 1 of the drawings wherein the opening 27 therein moves upwardly and away from the plug 23. The internal annular flanges 31 on the cylindrical body member 28 cannot move above the outwardly extending annular flange 34*b* on the upstanding cylindrical pour spout 20 so that the push-pull cap 25 cannot be removed therefrom. As shown in FIG. 12, flanges 31 and 32 on the cylindrical body member 28 of the pour spout closure 25 can be replaced with one or more continuous or discontinuous lower locking beads 50 and/or 51. Beads 50 and 51 may be conventionally shaped or may optionally be provided with upturned hook-like edges, similar in construction to the hook-shaped flange 16*c* on the tamper evident band 15, to engage complimentary shaped surfaces on pour spout flanges 34*a* and/or 34*b* to make it more difficult to disengage the push-pull cap 25 from the pour spout 20 as the push-pull cap 25 is moved from the closed to the open position. Additionally, the cylindrical body member 28 of the push-pull closure 25 may optionally be provided with one or more continuous or discontinuous upper locking beads 52 and/or 53, positioned to engage pour spout flanges 34*a* and/or 34*b* to prevent inadvertent opening of the push-pull cap 25 while in the closed position.

Figure 9A:
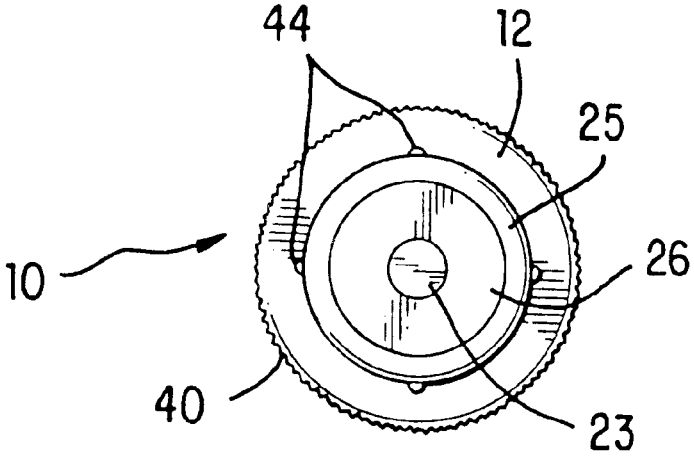
FIG. 9A is a top plan view of the push-pull cap.

As shown in FIGS. 7 and 9A, a plurality of circumferentially spaced dimples 44 optionally extend from the exterior wall of the pour spout 20. Dimples facilitate breaking the frangible elements 29 connecting the tamper evident band 30 to the spout closure 25. Dimples 44 can break the frangible elements 29 by either axial or rotational movement of the spout closure 25 relative to the pour spout 20. Referring to FIG. 8, the push-pull pour spout closure 10 may be seen in assembled condition illustrating an outside rib surface 40 on the depending annular flange 13.

Figure 11:
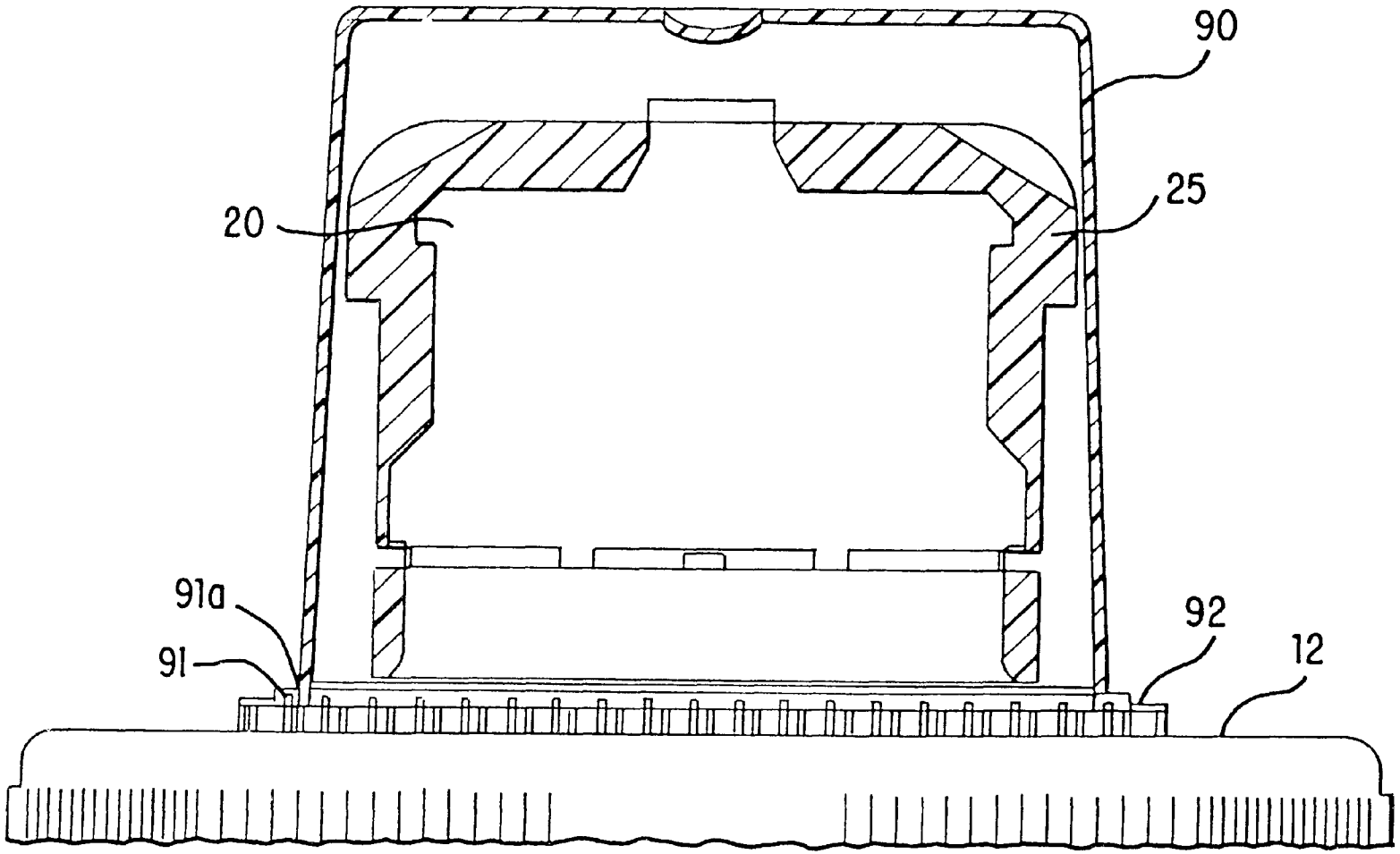
FIG. 11 is an exploded view of the resealable push-pull pour spout closure with tamper evident dust cover installed.

As shown in FIGS. 8A and 11, the present invention also optionally provides a dust cover 90 which encloses the push-pull pour spout closure when inserted on the container. The dust cover 90 may be optionally provided with an integral ratcheted tamper-evident sealing band 91 which engages teeth 91*a* integrally formed on the top of closure seal disc 12. Alternately, dust cover 90 may be provided with a tamper-evident sealing band containing at least one bead for engaging a structure on the closure such as for example at least one bead integrally formed on the top of closure seal disc 12, wherein said beads may be either continuous or discontinuous around their circumference. Tamper-evident sealing band 91 remains intact upon initial installation of the dust cover 90 onto the container. Dust cover 90 and tamper-evident band 91 are separated by the breaking of an line of weakness 92 formed at the intersection of the dust cover 90 and tamper-evident band 91. The purpose of the dust cover is to provide an indication of whether the push-pull pour spout closure has been exposed subsequent to the sealing of the container. When a dust cover 90 used with a tamper-evident sealing band 91, the use of a band 30 on the lower edge of the pour spout push-pull cap 25 for providing tamper-evidency is no longer necessary and may optionally be eliminated.

While presently preferred embodiments of the invention have been shown and described in particularity, the invention may be otherwise embodied within the scope of the appended claims.

What is claimed is:

1. A tamper indicating closure comprising a top portion, an annular depending skirt extending therefrom, a first tamper indicating ring connected to said depending skirt by at least one circumferentially positioned first frangible element, said first tamper indicating ring including at least one arcuate projection extending around at least a portion of said first tamper indicating ring arranged for registration with an annular locking flange on a container neck portion on which said closure is positioned, said depending skirt having at least one internal thread for engaging at least one external thread on the neck portion of said container, wherein the improvement comprises:

at least one said arcuate projection comprising a locking member extending radially inward from said first tamper indicating ring with a surface at an angle to a plane normal with said first tamper indicating ring;

wherein said first tamper indicating ring is connected in vertical spaced relation to said depending skirt by a plurality of circumferentially spaced first frangible elements; and further comprising at least one pair of cooperating ratchets wherein one ratchet of said pair depends from said first tamper indicating ring and the other ratchet of said pair depends from said closure depending skirt.

2. The tamper indicating closure of claim 1, wherein said locking member comprises a flange having an edge and a groove.

3. The tamper indicating closure of claim 2, wherein at least a portion of the surface of said flange lies substantially parallel to the interior surface of said tamper indicating band.

4. The tamper indicating closure of claim 1, wherein said first tamper indicating ring includes a plurality of annularly spaced first elevated bridge portions extending axially towards said depending skirt, wherein said first elevated bridge portions define areas of decreased ring spacing from said depending skirt.

5. The tamper indicating closure of claim 4, wherein at least one said first frangible element is connected to said annular wall between two said first elevated bridge portions.

6. The tamper indicating closure of claim 5, wherein at least one said first frangible element is connected to said annular wall from a first elevated bridge portion.

7. The tamper indicating closure of claim 4, wherein at least one said first frangible element is connected to said annular wall from a first elevated bridge portion.

8. The tamper indicating closure of claim 4, wherein said first tamper indicating ring includes a plurality of said arcuate projections arranged for registration with said annular locking flange on said container neck and wherein each of said arcuate projections are circumferentially aligned in vertical spaced relation to said first elevated bridge portions of said first tamper indicating ring.

9. The tamper indicating closure of claim 4 wherein said first elevated bridge portions extending from said annular ring are of a known vertical height, and said first frangible elements are of a height greater than that of said known height of said first elevated bridge portions.

10. The tamper indicating closure of claim 1, further comprising at least two said cooperating ratchet pairs.

11. The tamper indicating closure of claim 1, wherein said first tamper indicating ring includes a plurality of said arcuate projections arranged for registration with said annular locking flange on said container neck.

12. The tamper indicating closure of claim 1, wherein said locking member is continuous.

13. The tamper indicating closure of claim 1, wherein said locking member is discontinuous.

14. The tamper indicating closure of claim 1, wherein at least one said internal thread on said depending skirt comprises segments.

15. The tamper indicating closure of claim 14, wherein said segments are in spaced vertical alignment with one another.

16. The tamper indicating closure of claim 14, wherein said first tamper indicating ring includes a plurality of said arcuate projections arranged for registration with said annular locking flange on said container neck which are in overlapping annular offset alignment with said segments on said depending skirt.

17. The tamper indicating closure of claim 1, wherein said locking member further comprises a plurality of gussets extending upwardly from and in a direction substantially perpendicular to the sealing surface of said locking member to assist in dislodging said first tamper indicating ring from the remainder of said closure.

18. The tamper indicating closure of claim 1, further comprising a resealable push-pull pour spout closure assembly extending from said top portion of said closure, said push-pull pour spout closure assembly comprising:

A. a spout member defining a spout opening and having positioned in spaced relationship thereto a plug with at least one support member defining said relationship;

B. a slidable secondary closure member having a central opening therethrough for cooperation with said plug the improvement therein comprising said central opening having a diameter substantially the same as that of said plug, said central opening being defined by an inner surface having at least one annular seal flange projecting radially into said central opening for engagement with said plug.

19. The tamper indicating closure of claim 18 wherein said secondary closure member further comprises an annular wall depending from the periphery of said secondary closure member having at least one first internally extending annular flange being spaced a distance from said secondary closure member greater than the length of the inner surface of said central opening to permit said secondary closure member to slide and disengage said plug to permit a fluid to pass through said central opening.

20. The tamper indicating closure of claim 19, wherein said spout member includes at least one external flange for engaging at least one said internally extending annular flange to inhibit removal of said secondary closure member from said pour spout assembly.

21. The tamper indicating closure of claim 20, wherein said secondary closure member further comprises at least one second internally extending annular flange positioned to engage said at least one external flange to prevent inadvertent movement of said secondary closure member while said secondary closure member is in a closed position.

22. The tamper indicating closure of claim 21, further comprising at least two said second internally extending annular flanges.

23. The tamper indicating closure of claim 20, further comprising at least two said external flanges.

24. The tamper indicating closure of claim 19, further comprising a second tamper indicating ring connected to said annular wall.

25. The tamper indicating closure of claim 24, wherein said second tamper indicating ring is connected in vertical spaced relation to said annular wall by a plurality of circumferentially spaced second frangible elements.

26. The tamper indicating closure of claim 25, wherein said second tamper indicating ring includes a plurality of annularly spaced second elevated bridge portions extending axially towards said annular wall, wherein said second elevated bridge portions define areas of decreased ring spacing from said annular wall.

27. The tamper indicating closure of claim 26, wherein at least one said second frangible element is connected to said annular wall between two said second elevated bridge portions.

28. The tamper indicating closure of claim 27, wherein at least one said second frangible element is connected to said annular wall from a second elevated bridge portion.

29. The tamper indicating closure of claim 26 wherein said second elevated bridge portions extending from said second tamper indicating ring are of a known vertical height, and said second frangible elements are of a height greater than that of said known height of said second elevated bridge portions.

30. The tamper indicating closure of claim 26, wherein at least one said second frangible element is connected to said annular wall from a second elevated bridge portion.

31. The tamper indicating closure of claim 24, further comprising a plurality of circumferentially spaced dimples extending from said spout member.

32. The tamper indicating closure of claim 31, wherein said dimples facilitate breaking a plurality of circumferentially spaced second frangible elements connecting said second tamper indicating ring to said annular wall.

33. The tamper indicating closure of claim 31, wherein said dimples are spaced equally around the circumference of said spout member.

34. The tamper indicating closure of claim 19, further comprising at least two said first internally extending annular flanges.

35. The tamper indicating closure of claim 18, wherein said central opening of said secondary closure member includes at least two said annular seal flanges.

36. The tamper indicating closure of claim 18, wherein at least one said annular seal flange is continuous.

37. The tamper indicating closure of claim 18, wherein at least one said annular seal flange is discontinuous.

38. The tamper indicating closure of claim 18, wherein said plug comprises a circular disk and an integral depending annular skirt extending from the periphery of said disk to attach said disk to said support member thereby defining a hollow cavity within said plug.

39. The tamper indicating closure of claim 18, further comprising a cover attached to said closure for enclosing said push-pull pour spout closure assembly.

40. The tamper indicating closure of claim 39, wherein said cover is attached to said closure by a third tamper indicating ring.

41. The tamper indicating closure of claim 40, wherein said third tamper indicating ring includes ratcheted teeth for engaging ratcheted teeth positioned on said top portion of said closure.

42. The tamper indicating closure of claim 40, wherein said third tamper indicating ring includes at least one annular bead for engaging at least one annular bead positioned on said closure.

43. The tamper indicating closure of claim 42, wherein at least one of said annular beads is continuous.

44. The tamper indicating closure of claim 42, wherein at least one of said annular beads is discontinuous.

45. The tamper indicating closure of claim 40, wherein said secondary closure member has no means for providing tamper evidency.

46. The tamper indicating closure of claim 39, wherein said cover has no means for providing tamper evidency.

47. The tamper indicating closure of claim 39, wherein said cover is configured for snap-on installation to said closure.

48. The tamper indicating closure of claim 1, wherein said locking member is positioned adjacent to the bottom surface of said tamper indicating band.

49. The tamper indicating closure of claim 1, wherein at least one said internal thread engages at least one said external thread to permit said closure to be screwed on and off said container neck.

* * * * *